US010168641B2

(12) United States Patent
Shirakata

(10) Patent No.: US 10,168,641 B2
(45) Date of Patent: Jan. 1, 2019

(54) DEVELOPING DEVICE, PROCESS CARTRIDGE AND ELECTROPHOTOGRAPHIC IMAGE FORMING APPARATUS HAVING DEVELOPER SUPPLY MEMBER PASSING THROUGH DEVELOPING OPENING

(71) Applicant: CANON KABUSHIKI KAISHA, Tokyo (JP)

(72) Inventor: Sho Shirakata, Kawasaki (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/687,939

(22) Filed: Aug. 28, 2017

(65) Prior Publication Data

US 2017/0357184 A1 Dec. 14, 2017

Related U.S. Application Data

(62) Division of application No. 14/601,441, filed on Jan. 21, 2015, now Pat. No. 9,785,090.

(30) Foreign Application Priority Data

Jan. 29, 2014 (JP) ..... 2014-014167
Nov. 11, 2014 (JP) ..... 2014-228903

(51) Int. Cl.
*G03G 15/08* (2006.01)

(52) U.S. Cl.
CPC . *G03G 15/0887* (2013.01); *G03G 2215/0819* (2013.01); *G03G 2215/0844* (2013.01)

(58) Field of Classification Search
CPC ..... G03G 15/0887
See application file for complete search history.

(56) References Cited

U.S. PATENT DOCUMENTS 5,913,097 A * 6/1999 Nakano ..... G03G 15/0822 366/309
6,347,207 B1 2/2002 Ishiguro et al.
(Continued)

FOREIGN PATENT DOCUMENTS

CN 101236380 A 8/2008
CN 101639648 A 2/2010
(Continued)

OTHER PUBLICATIONS

Chinese Office Action dated Sep. 5, 2018, in corresponding Chinese Patent Application No. 201510044356.X (with English translation).

*Primary Examiner* — Walter L Lindsay, Jr.
*Assistant Examiner* — Arlene Heredia Ocasio
(74) *Attorney, Agent, or Firm* — Venable LLP

(57) ABSTRACT

A developing device includes a developer carrying member for developing an electrostatic image with a developer, a developer container including a developing opening, and a developer supplying member for supplying the developer to a developing chamber through the developing opening. The developer supplying member includes a shaft member rotatably supported by the developer accommodating portion and a feeding member, wherein the feeding member includes a first feeding portion and a second feeding portion. The first feeding portion is provided in a downstream side, and the second feeding portion is provided in an upstream side with respect to a rotational direction of the shaft member.

12 Claims, 18 Drawing Sheets

(56) References Cited

U.S. PATENT DOCUMENTS

| | | | | |
|---|---|---|---|---|
| 6,456,810 | B1 | 9/2002 | Deguchi et al. | |
| 6,526,245 | B1 | 2/2003 | Yamashita | |
| 7,369,792 | B2 | 5/2008 | Shiraki | |
| 7,386,253 | B2 | 6/2008 | Ishii et al. | |
| 7,412,188 | B2 | 8/2008 | Ishii et al. | |
| 7,450,882 | B2 | 11/2008 | Shiraki | |
| 7,522,859 | B2 | 4/2009 | Ishii et al. | |
| 7,565,092 | B2 | 7/2009 | Shiraki | |
| 7,796,915 | B2 | 9/2010 | Ishii et al. | |
| 7,844,197 | B2 | 11/2010 | Ishii et al. | |
| 7,848,682 | B2 * | 12/2010 | Tanaka | G03G 15/0877 399/254 |
| 7,860,437 | B2 | 12/2010 | Kakuta et al. | |
| 7,873,296 | B2 | 1/2011 | Ishii et al. | |
| 7,941,073 | B2 | 5/2011 | Takagi et al. | |
| 7,957,669 | B2 | 6/2011 | Ishii et al. | |
| 7,957,680 | B2 | 6/2011 | Sato | |
| 8,185,023 | B2 | 5/2012 | Kakuta et al. | |
| 8,326,185 | B2 | 12/2012 | Asanuma et al. | |
| 8,532,544 | B2 | 9/2013 | Kakuta et al. | |
| 9,164,427 | B2 * | 10/2015 | Kobayashi | G03G 15/0877 |
| 2007/0269238 | A1 | 11/2007 | Sato | |
| 2008/0205939 | A1 | 8/2008 | Mase et al. | |
| 2009/0274491 | A1 * | 11/2009 | Sato | G03G 15/0896 399/281 |
| 2013/0259530 | A1 | 10/2013 | Kato et al. | |
| 2014/0186072 | A1 | 7/2014 | Sato | |
| 2017/0285520 | A1 * | 10/2017 | Yoshida | G03G 15/0865 |

FOREIGN PATENT DOCUMENTS

| | | | |
|---|---|---|---|
| CN | 102117034 | A | 7/2011 |
| JP | 2001-027840 | A | 1/2001 |
| JP | 2001-100501 | A | 4/2001 |
| JP | 2002-236410 | A | 8/2002 |
| JP | 2005-070363 | A | 3/2005 |
| JP | 2006-208433 | A | 8/2006 |
| JP | 2007-310150 | A | 11/2007 |

* cited by examiner

DEVELOPING DEVICE, PROCESS CARTRIDGE AND ELECTROPHOTOGRAPHIC IMAGE FORMING APPARATUS HAVING DEVELOPER SUPPLY MEMBER PASSING THROUGH DEVELOPING OPENING

This application is a divisional of application Ser. No. 14/601,441, filed Jan. 21, 2015.

FIELD OF THE INVENTION AND RELATED ART

The present invention relates to an electrophotographic image forming apparatus, a developing device used in a main assembly of the electrophotographic image forming apparatus, and a process cartridge. The electrophotographic image forming apparatus forms an image on a recording material by using an electrophotographic image forming process. For example, the electrophotographic image forming apparatus includes an electrophotographic copying machine, an electrophotographic printer (LED printer, laser beam printer or the like), an electrophotographic facsimile machine, an electrophotographic word processor, or the like.

Further, the developing device is mounted in the main assembly of the electrophotographic image forming apparatus, and develops an electrostatic image formed on an electrophotographic photosensitive member. This developing device has a mounted constitution in which the developing device is mounted and used in the main assembly of the electrophotographic image forming apparatus or a developing cartridge constitution in which the developing device is detachably mountable to the main assembly of the electrophotographic image forming apparatus.

Further, the process cartridge is prepared by integrally assembling the electrophotographic photosensitive member and the developing device actable on the electrophotographic photosensitive member into a cartridge (unit), and is made detachably mountable to the main assembly of the electrophotographic image forming apparatus.

A conventional electrophotographic image forming apparatus using the electrophotographic image forming process employs a cartridge type. According to this cartridge type, a user can perform maintenance of the electrophotographic image forming apparatus by himself (herself) without relying on a service person, and therefore operativity of the maintenance can be remarkably improved.

In the process cartridge and the developing device which are used in the cartridge type, as a means for feeding a developer from a developer container to a developing means and for stirring the developer, a method of rotating an elastic sheet 50 as shown in FIG. 18 is used. Specifically, in a developer accommodating portion 21*a*, a stirring means 26 rotatable in an arrow RR direction is provided. Further, the stirring means 26 is constituted by a shaft member 60 as a base member and the elastic sheet 50 as a developer feeding member. Then, the shaft member 60 and the elastic sheet 50 are integrally rotated in the arrow RR direction, so that a toner T is fed from the developer accommodating portion 21*a* to a developing chamber 21*a* through a developing opening 21*d*. With respect to this stirring means, a constitution in which in order to prevent high density of the toner T in the developing chamber 21*c*, an elastic sheet free end portion 50*a* enters the developing chamber 21*c* when it reaches the developing opening 21*d*, and stirs the toner in the developing chamber 21*c* has been known (Japanese Laid-Open Patent Application (JP-A) 2005-070363). The high density of the toner T in the developing chamber 21*c* is referred to as a "toner packing".

Further, in a constitution in which the developer accommodating portion 21*a* is upsized to accommodate the toner T in a larger amount in the developer accommodating portion 21*a*, a constitution in which a plurality of stirring means are provided in the developer accommodating portion 21*a* has been known (JP-A 2006-208433).

However, in the case where the developer accommodating portion is upsized, according to the constitution in JP-A 2005-070363, in order to stir the toner in the upsized developer accommodating portion by a single stirring means, there is a need to elongate the elastic sheet. As a result, the case where the elastic sheet free end portion enters the developing chamber to contact a developer carrying member exists, so that there was a liability that an image defect was caused. Therefore, in the conventional constitution, a dimension of the elastic sheet free end portion was strictly controlled. Further, according to the constitution of JP-A 2006-208433, the plurality of stirring means are provided, so that a cost is increased.

SUMMARY OF THE INVENTION

A principal object of the present invention is not only to feed a developer, accommodated in an upsized developer accommodating portion, to a developing chamber but also to stir the developer in the developing chamber with an inexpensive constitution.

According to an aspect of the present invention, there is provided a developing device comprising: a developer carrying member for developing an electrostatic image with a developer; a developer container including a developer accommodating portion for accommodating the developer, a developing opening and a developing chamber; and a developer supplying member for supplying the developer to the developing chamber through the developing opening, wherein the developer supplying member includes a shaft member rotatably supported by the developer accommodating portion and a feeding member, wherein the feeding member includes a first feeding portion which has a length L1 measured in an axial direction of the developer carrying member and a radius R1 measured from a rotation center of the shaft member, and includes a second feeding portion which has a length L2 measured in the axial direction of the developer carrying member and a radius R2 measured from the rotation center of the shaft member, and wherein when a length of the developing opening with respect to the axial direction of the developer carrying member is L3, a shortest length from the developing opening to the rotation center of the shaft member is L4, and a length from the developer carrying member to the rotation center of the shaft member is L5, the following relationships are satisfied:

$$L1<L3<L2, \text{ and}$$

$$L4<R1<L5.$$

These and other objects, features and advantages of the present invention will become more apparent upon a consideration of the following description of the preferred embodiments of the present invention taken in conjunction with the accompanying drawings.

DESCRIPTION OF THE EMBODIMENTS

Embodiments of the present invention will be described specifically with reference to the drawings. However, with respect to functions, materials, shapes, relative arrangements and the like of constituent elements described in the following embodiments, the scope of the present invention is not intended to be limited to only the embodiments unless otherwise specified. Further, the materials, the shapes and the like of members which have already been described in the following description are the same as those first described in the following embodiment unless otherwise specified again.

Embodiment 1

A developing device, a process cartridge and an electrophotographic image forming apparatus according to the present invention will be described with reference to the drawings.

In the following description, a longitudinal direction of the process cartridge coincides with a rotational direction of an electrophotographic photosensitive member as an image bearing member and an axial direction of a developer carrying member. Further, a short direction of the process cartridge is a direction crossing a rotation shaft of the electrophotographic photosensitive member and coincides with a laser irradiation direction. Further, above and below the process cartridge mean those in a state the process cartridge is mounted in a main assembly of the image forming apparatus.

General Structure of Image Forming Apparatus

Figure 2:
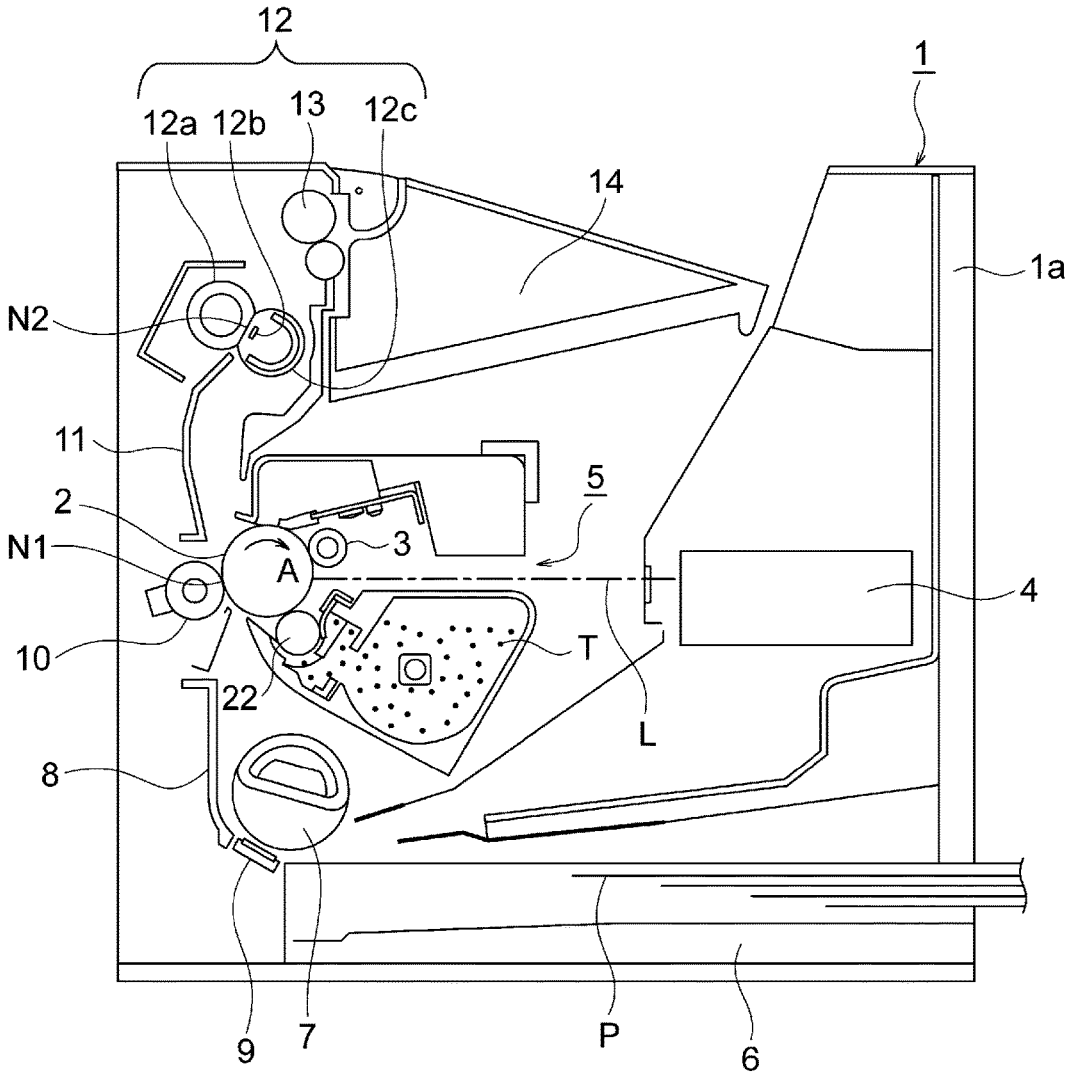
FIG. 2 is a sectional view showing a general structure of an image forming apparatus in Embodiment 1.

First, a general structure of an electrophotographic image forming apparatus 1 in this embodiment will be described with reference to FIG. 2. FIG. 2 is a sectional view showing a structure of the image forming apparatus 1. The image forming apparatus 1 shown in FIG. 2 forms an image with a developer on a recording material P (such as recording paper, OHP sheet or cloth) depending on image information from an external device, such as a personal computer, communicatably connected with the image forming apparatus 1.

A drum-shaped electrophotographic photosensitive member (hereinafter referred to as a photosensitive drum) 2 is rotated in an arrow A direction, so that a surface of the photosensitive drum 2 is electrically charged uniformly by a charging roller 3 as a charging means. The photosensitive drum 2 is irradiated with laser light L emitted from an optical means (exposure means) 4 depending on image information, so that an electrostatic image depending on the image information is formed in the photosensitive drum 2. The electrostatic image formed on the photosensitive drum 2 is developed with a toner T as a developer by a developer carrying member 22 described later, so that a toner image is formed.

On the other hand, in synchronism with formation of the toner image, the recording material P set in a feeding cassette 6 is separated and fed one by one by a pick-up roller 7 and a press-contact member 9 press-contactable to the pick-up roller 7. Then, the recording material P is fed toward a transfer 10 as a transfer means along a feeding guide 8. Then, the recording material P passes through a transfer nip N1 formed by the photosensitive drum 2 and the transfer roller 10 to which a certain voltage is applied. At this time, the toner image formed on the photosensitive drum 2 is transferred onto the recording material P. The recording material P on which the toner image is transferred is fed along a feeding guide 11 into a fixing means 12 consisting of a driving roller 12*a* and a fixing roller 12*c* incorporating a heater 12*b*. Then, heat and pressure are applied to the recording material P passing through a nip N2 formed by the fixing roller 12*c* and the driving roller 12*a*, so that the transferred toner image is fixed on the recording material P. Thereafter, the recording material P is fed by a discharging roller pair 13 and is discharged onto a discharge tray 14.

Process Cartridge

Figure 3:
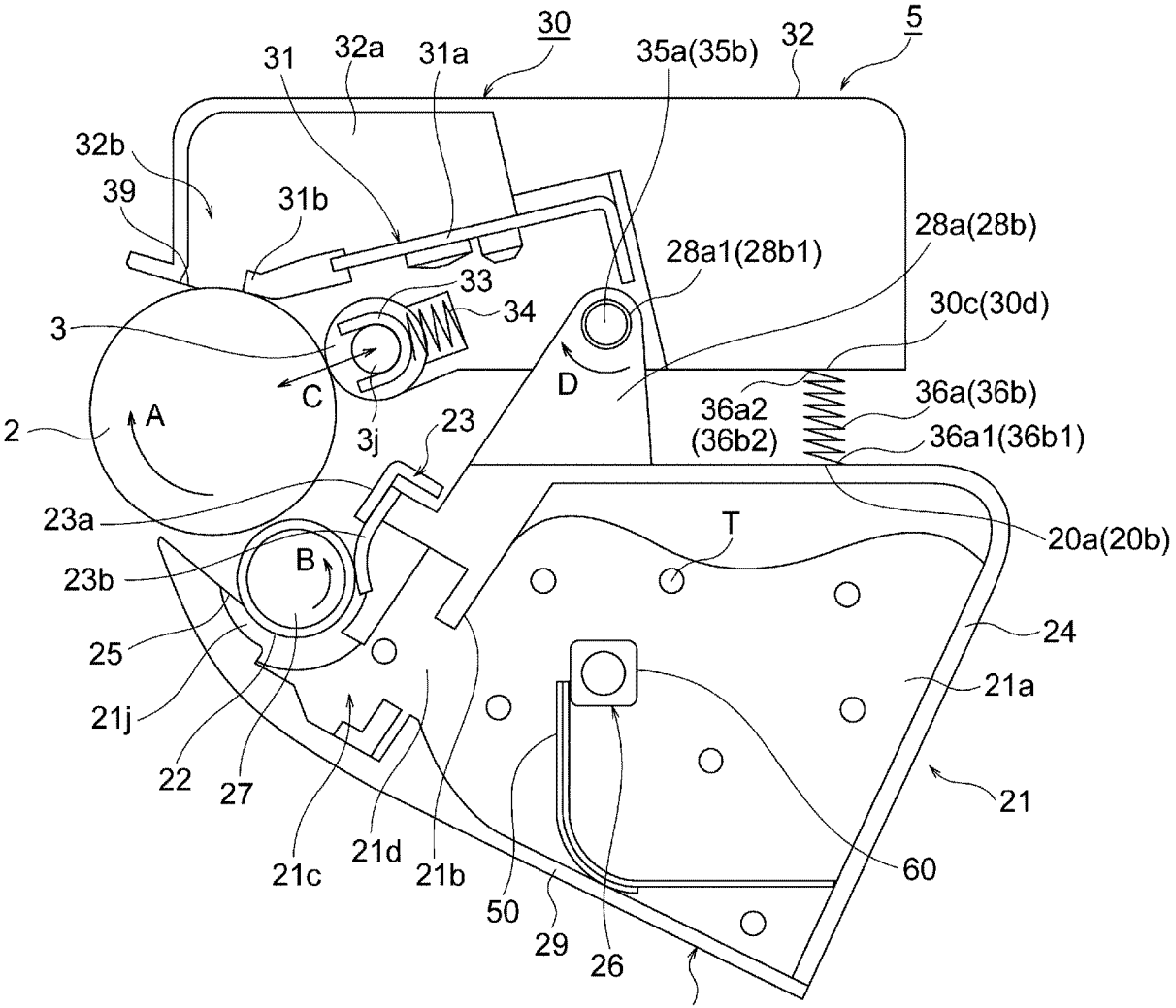
FIG. 3 is a sectional view of a process cartridge.

A process cartridge 5 detachably mountable to the image forming apparatus 1 in this embodiment will be described with reference to FIGS. 3 and 4. FIG. 3 is a sectional view showing a structure of the process cartridge 5, and FIG. 4 is an exploded perspective view of the process cartridge 5.

As shown in FIG. 3, the process cartridge 5 is constituted by a photosensitive unit 30 and a developing unit 20 as a developing device. The photosensitive unit 30 includes the photosensitive drum 2, the charging roller 3, a cleaning means (cleaning blade) 31 and the like. Further, the developing unit 20 includes a developer container 21, a developer carrying member 22, a developer layer thickness regulating means 23 and the like.

Figure 4:
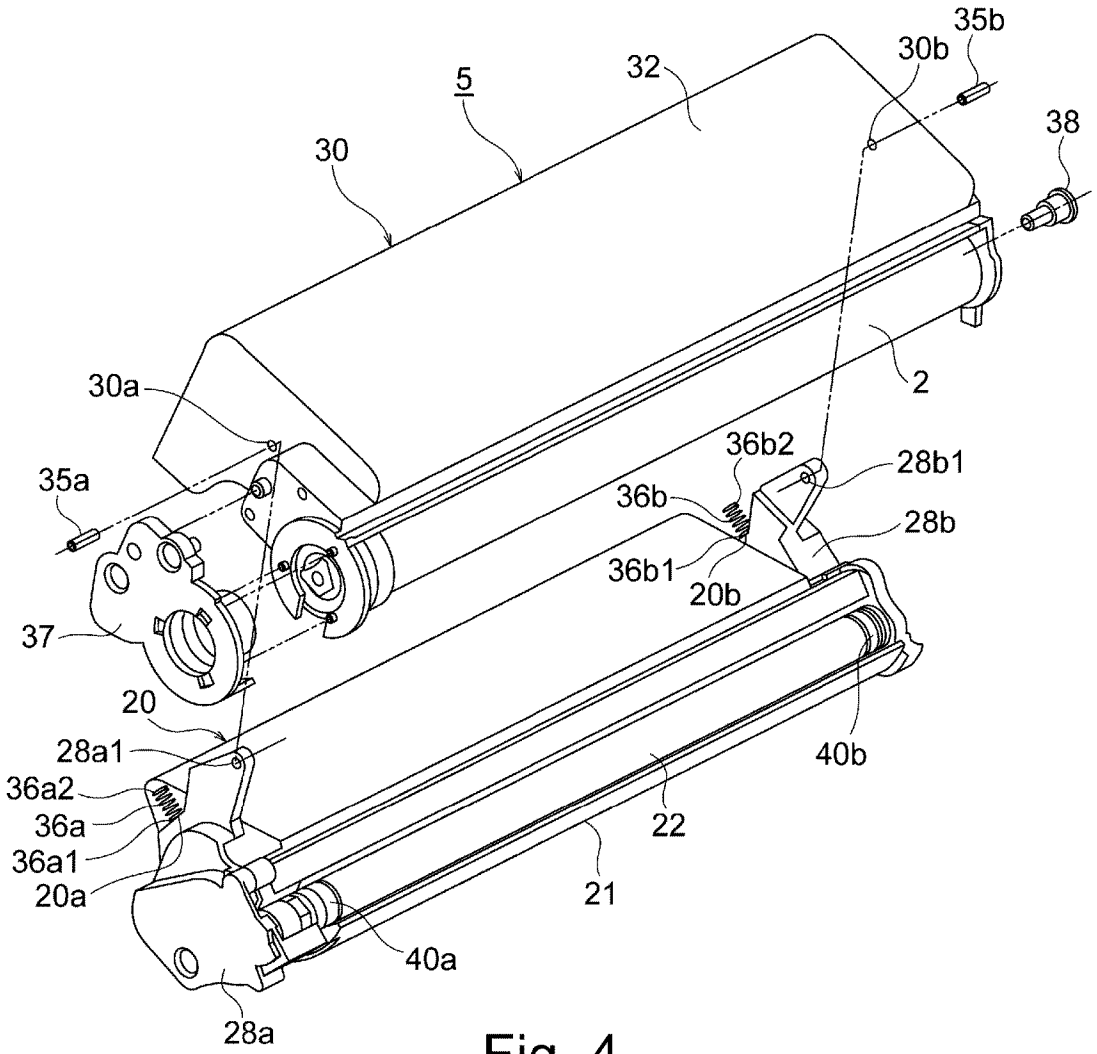
FIG. 4 is an exploded perspective view of the process cartridge.

The electroconductive photosensitive drum 2 having the surface coated with a photosensitive layer is rotatably mounted in a cleaning (device) frame 32 of the photosensitive unit 30 via drum bearings 37 and positioning pins 38 (FIG. 4). Then, when a driving force is transmitted, depending on an image forming operation, to the photosensitive unit 30 from a driving motor (not shown) provided in the image forming apparatus 1, the photosensitive drum 2 is rotated in an arrow A direction. Further, the charging roller 3 is urged by a spring 34 so that the charging roller 3 is contacted to the photosensitive drum 2 at a certain pressure with respect to a rectilinear line passing through centers of the charging roller 3 and the photosensitive drum 2. In addition, the charging roller 3 electrically charges the surface of the photosensitive drum 2 uniformly by a voltage applied from the image forming apparatus 1. Then, the charged photosensitive drum 2 is exposed to the laser light L from the optical means 4, so that the electrostatic image is formed on the photosensitive drum 2.

On the other hand, the developer container 21 constituting the developing unit 20 is formed by fixing the developing chamber 24 and a developing chamber cover 29 by ultrasonic welding or the like. The developing chamber 21 includes a developer accommodating portion 21*a* accommodating the toner T, a developing chamber 21*c*, a partition wall portion 21*b* partitioning an inside of the developer container 21 into the developer accommodating portion 21*a* and the developing chamber 21*c*, and a developing opening 21*d* through which the developer accommodating portion 21*a* and the developing chamber 21*c* communicate with each other. Further, a stirring means 26 as a developer supplying member is rotatably supported by the developer container 21, and by rotation of the stirring means 26, the toner T is fed from the developer accommodating portion 21*a* into the developing chamber 21*c* through the developing opening 21*d*. The developer carrying member 22 is rotatably supported by the developer container 21 as specifically described later. The developer carrying member 22 incorporates a fixed magnet 27, and by a magnetic force of the fixed magnet 27, the toner T in the developing chamber 21*c* is attracted to the surface of the developer carrying member 22. Further, the regulating means 23 is fixed to the developer container 21 so as to elastically contact the developer carrying member 22 at a certain contact pressure. Then, the regulating means 23 regulates an amount of the toner T deposited on the developer carrying member 22 and imparts triboelectric charges to the toner T. As a result, a developer layer is formed on the surface of the developer carrying member 22. Further, a blow-off preventing sheet 25 is mounted on the developer container 21 so as to contact the developer carrying member 22 to prevent leakage-out of the toner T from between the developing chamber 21*c* and the developer carrying member 22. The developer carrying member 22 to which a voltage is applied from the image forming apparatus 1 rotates in an arrow B direction, so that the toner T is transferred therefrom onto the photosensitive drum 2 depending on the electrostatic image to visualize the electrostatic image on the photosensitive drum 2, and thus forms a developer image.

Further, a cleaning blade 31 is fixed and supported by the cleaning frame 32 and is provided so that a free end 31*b* of the cleaning blade 31 is elastically contacted to the photosensitive drum 2 at a certain contact pressure. Then, the cleaning blade 31 scrapes off the developer T remaining on the photosensitive drum 2 after the developer image is transferred onto the recording material P. The developer T which is scraped off is accommodated in a residual toner accommodating portion 32*a*. Further, a receptor sheet 39 is mounted on the cleaning frame 32 so as to be contacted to the photosensitive drum 2 to prevent leakage-out of the developer T from between the residual toner accommodating portion 32*a* and the photosensitive drum 2.

As shown in FIG. 4, the developer carrying member 22 is rotatably supported by the developer container 21 via developing bearings 28*a* and 28*c* mounted at longitudinal end portions of the developer container 21.

Further, the developer carrying member 22 is provided with spacer rollers 40*a* and 40*b* which are gap holding members rotatably supported at ends thereof with respect to a longitudinal direction (axial direction) in order to keep a certain clearance from the photosensitive drum 2.

The developing bearing 28*a* and 28*b* are provided with holes 28*a*1 and 28*b*1, respectively. Thus, the developing unit 20 is provided with holes 28*a*1 and 28*b*1. The photosensitive unit 30 is provided with holes 30*a* and 30*b* at longitudinal ends thereof. Further, the holes 28*a*1 and 30*a* are rotatably connected by a connecting shaft 35*a* as a connecting member, and the holes 28*b*1 and 30*b* are rotatably connected by a connecting shaft 35*b* as the connecting member. As a result, the developing unit 20 is supported by the photosensitive unit 30 rotatably about the connecting shafts 35*a* and 35*b*. To the supporting portions 20*a* and 20*b* provided at the longitudinal end portions of the developing unit 20, one end portion 36*a*1 of a pressing spring 36*a* and one end portion 36*b*1 of a pressing spring 36*b* are mounted, respectively. Further, when the developing unit 20 and the photosensitive unit 30 are connected by the connecting shafts 35*a* and 35*b*, the other end portion 36*a*2 of the pressing spring 36*a* contacts a receiving surface 30*c* of the photosensitive unit 30. Similarly, the other end portion 36*b*2 of the pressing spring 36*b* contacts a receiving surface 30*d* of the photosensitive unit 30. Then, the pressing springs 36*a* and 36*b* are compressed between the receiving surfaces 30*c* and 30*d* of the photosensitive unit 30 and the supporting portions 20*a* and 20*b* of the developing unit 20. For this reason, the developing unit 20 is urged toward the photosensitive drum 2 by moment D around the connecting shafts 35*a* and 35*b*. At that time, the above-mentioned spacer rollers 40*a* and 40*b* contact the photosensitive drum 2, so that the photosensitive drum 2 and the developer carrying member 22 are held with the certain clearance.

In this embodiment, a gear portion (not shown) of the photosensitive drum 2 and a drive transmitting portion (not shown) such as a gear provided to the developing unit 20 are engaged with each other, so that the driving force is transmitted from the photosensitive drum 2 to the developer carrying member (developing roller) 22 and the stirring means 26. The developing roller 22 and the like may also be rotated by a means for directly driving the developing roller 22 and the like from the image forming apparatus 1 or by the like means.

Stirring Means

Figure 1:
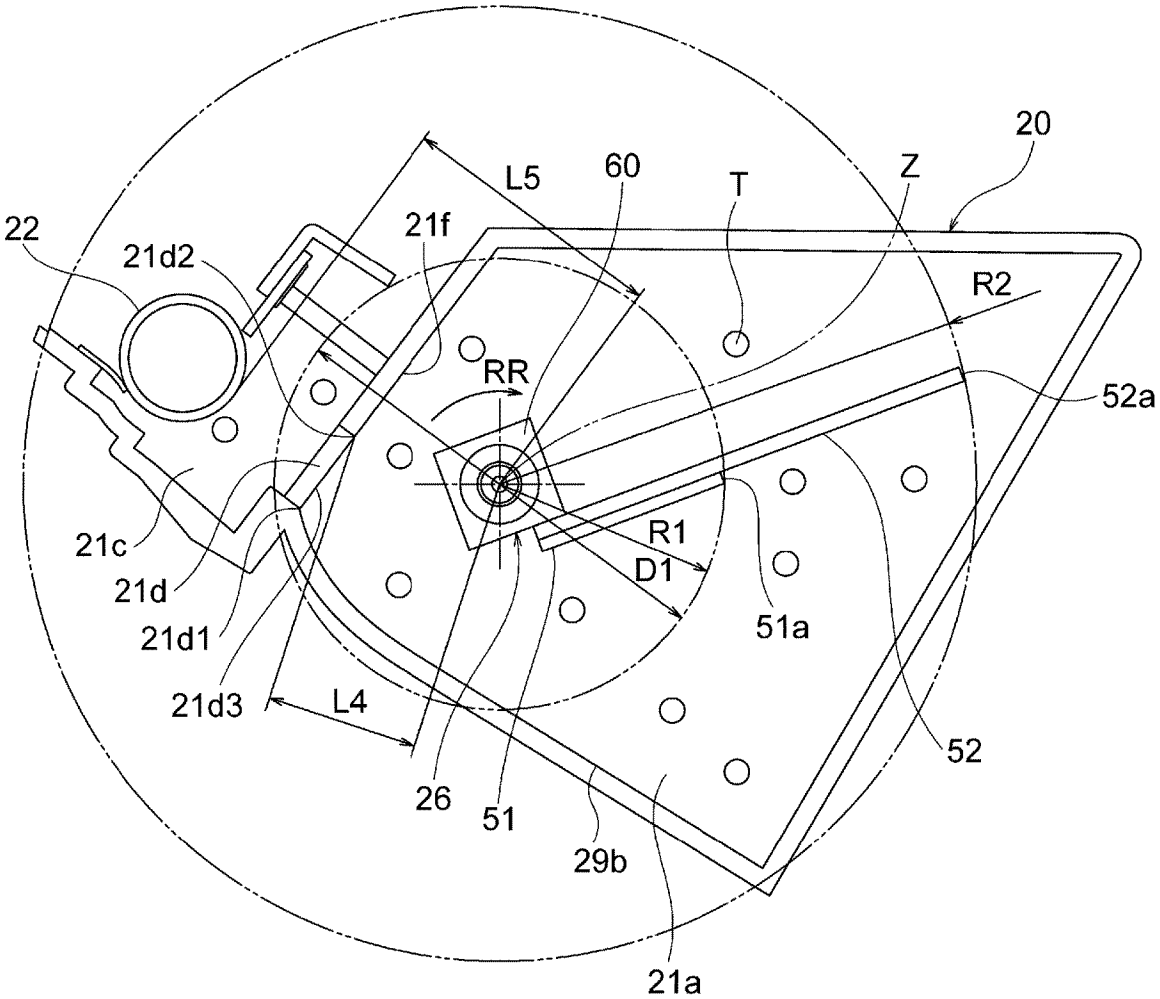
FIG. 1 is a sectional view for illustrating a structure of a first feeding portion and a second feeding portion in Embodiment 1.
Figure 5:
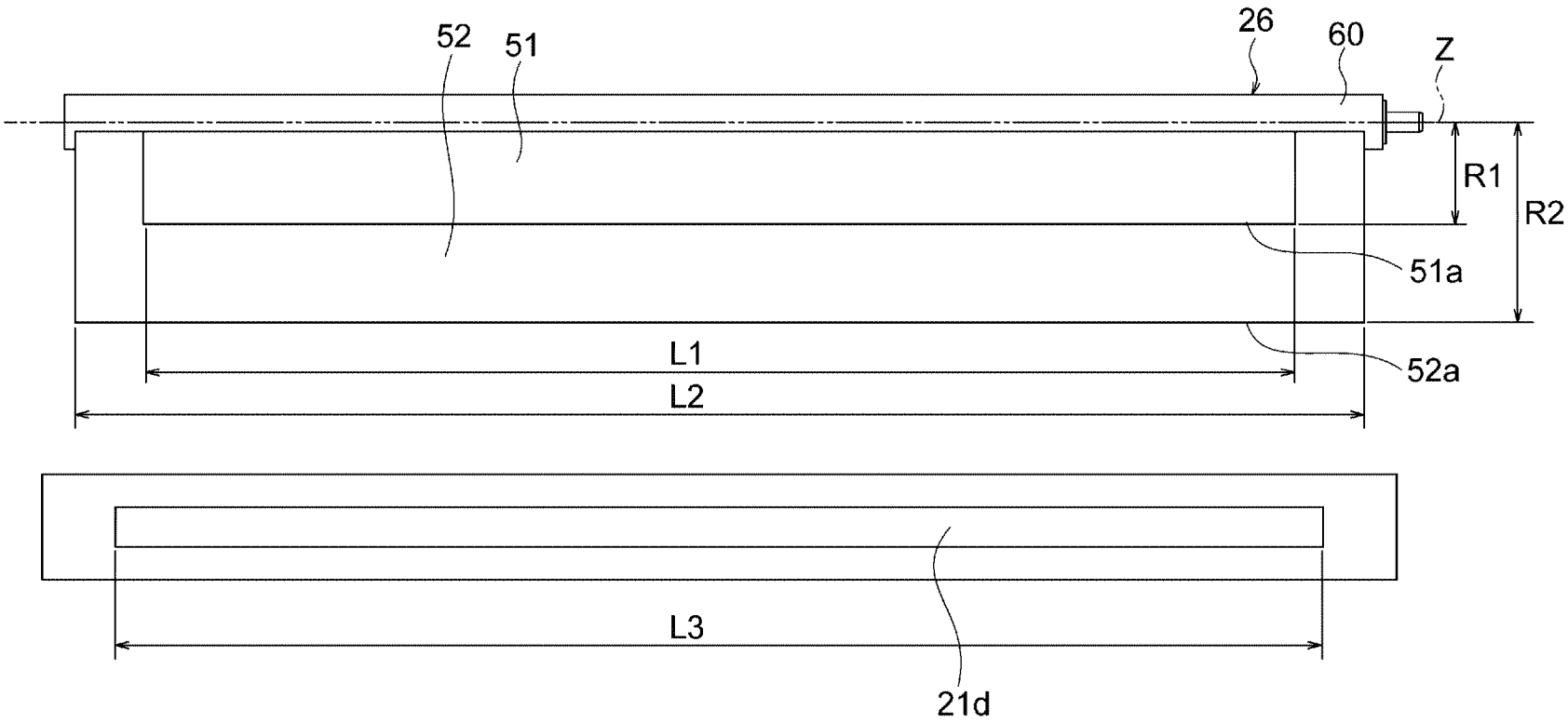
FIG. 5 is a schematic illustration of a developing opening and a stirring means in Embodiment 1.

A structure of the stirring means 26 in this embodiment will be described with reference to FIGS. 1 and 5. FIG. 1 is a sectional view, of the developing unit 20, showing the structure of the stirring means 26. FIG. 5 is a schematic view showing structures of the stirring means 26 and the developing opening 21*d* and a positional relationship between the stirring means 26 and the developing opening 21*d*.

As shown in FIG. 1, the stirring means 26 is constituted by a shaft member 60 as a base member (substrate) and a feeding member fixed on the shaft member 60. The feeding member is constituted by a first elastic sheet 51 as a first feeding portion and a second elastic sheet 52 as a second feeding portion. A free end portion 51*a* of the first elastic sheet 51 passes through the developing opening 21*d* and feeds the toner T in the developing chamber 21*c*. A free end portion 52*a* of the second elastic sheet 52 feeds the toner in the developer accommodating portion 21*a*. Specifically, the first elastic sheet 51 has the first elastic sheet free end portion 51*a* having a distance R1 as a radius from a rotation center Z of the shaft member 60, and the second elastic sheet 52 has the second elastic sheet free end portion 52*a* having a distance R2 as a radius from the rotation center Z. The first elastic sheet 51 is rotated by rotation of the shaft member 60 about the rotation center Z in a rotational direction RR, and can feed and stir the toner T in a feeding region D1 which is a locus drawn by the elastic sheet free end portion 51*a*.

The developer accommodating portion 21*a* and the developing chamber 21*c* are partitioned by a side 21*f*, of the developer accommodating portion 21, connected with the developing opening 21*d* and an accommodating portion-side opening region 21*d*3, of the developer accommodating portion 21, which is a region overlapping with the developing opening 21*d*. The side 21*f* and the opening region 21*d*3 constitute a boundary between the developer accommodating portion 21*a* and the developing chamber 21*c*. A length from the rotation center Z of the shaft member 60 to an opening downstream end portion 21*d*2, in the accommodating portion-side opening region 21*d*3, which is a downstream end portion with respect to the rotational direction is a distance L4, and length from the rotation center Z to the developer carrying member 22 is a distance L5. The distance L4 is the shortest distance from the rotation center Z to the region 21*d*3. The distance L4 may also be a distance from the rotation center Z of the shaft member 60 to an edge, of the developer container 21, defining the developing opening 21*d* or a distance from the rotation center Z to a center of a space of the developing opening 21*d*. The above-mentioned distances are set to satisfy the following relationship:

(distance L4)<(distance R1)<(distance L5)<(distance R2)

Further, as shown in FIG. 5, when a longitudinal length of the first elastic sheet 51 is a distance L1, a longitudinal length of the second elastic sheet 52 is a distance L2, and a longitudinal length of the developing opening 21*d* is a distance L3, these distances are set to satisfy the following relationship:

(distance L1)<(distance L3)<(distance L2).

By satisfying the above relationships, the first elastic sheet free end portion 51*a* can pass through the developing opening 21*d* and therefore can enter the developing chamber 21*c*. Then, the free end portion 51*a* can loosen the toner T in the developing chamber 21*c* without contacting the developer carrying member 22, so that a degree of the toner packing can be reduced. On the other hand, the second elastic sheet free end portion 52*a* cannot pass through the developing opening 21*d*, and therefore cannot enter the developing chamber 21*a*. Therefore, also the free end portion 52*a* does not contact the developer carrying member 22.

Figure 6:
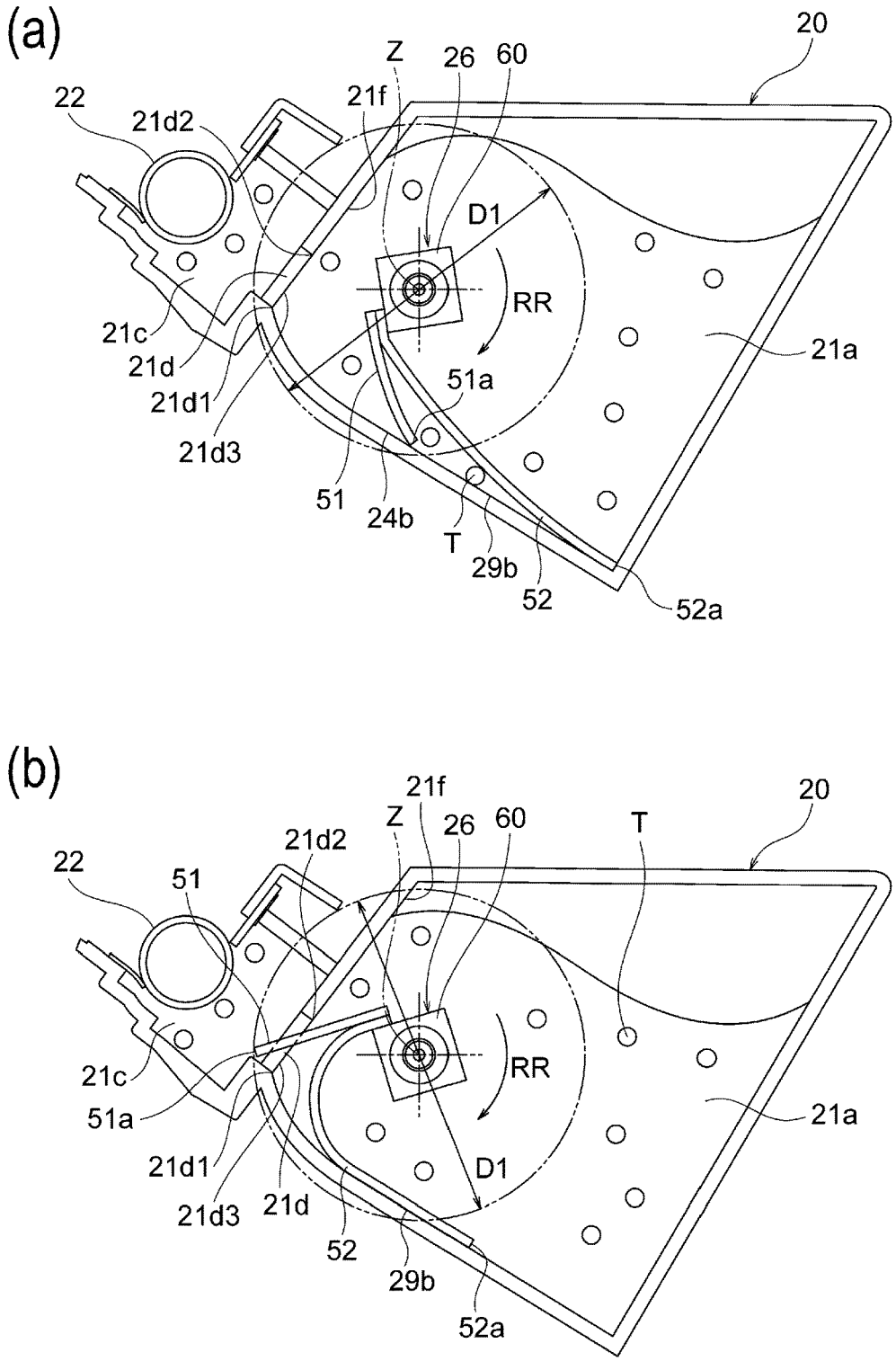
In FIG. 6, (a) and (b) are sectional views for illustrating behavior of the first feeding portion and the second feeding portion in Embodiment 1.
Figure 7:
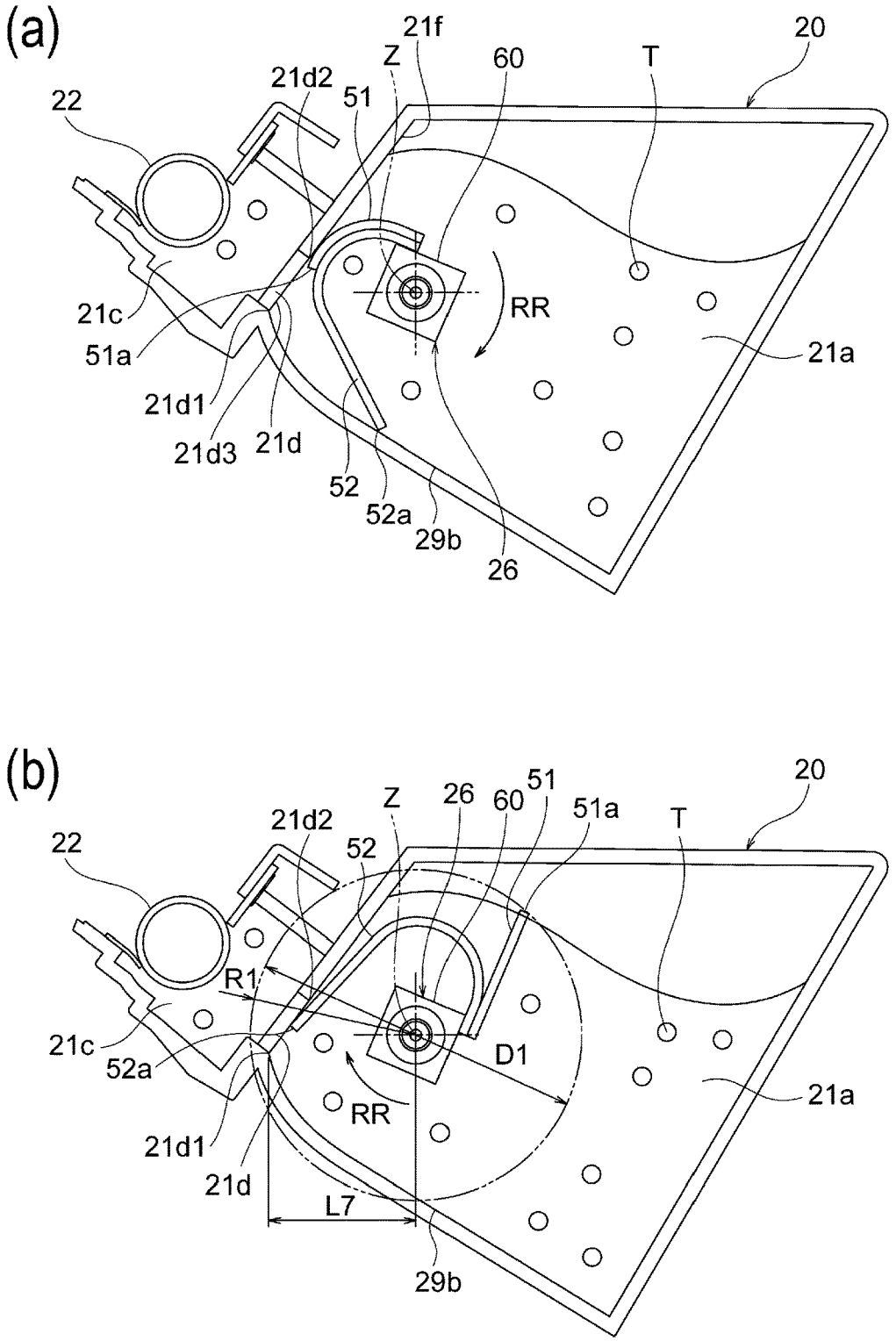
In FIG. 7, (a) and (b) are sectional views for illustrating the behavior of the first feeding portion and the second feeding portion in Embodiment 1.
Figure 8:
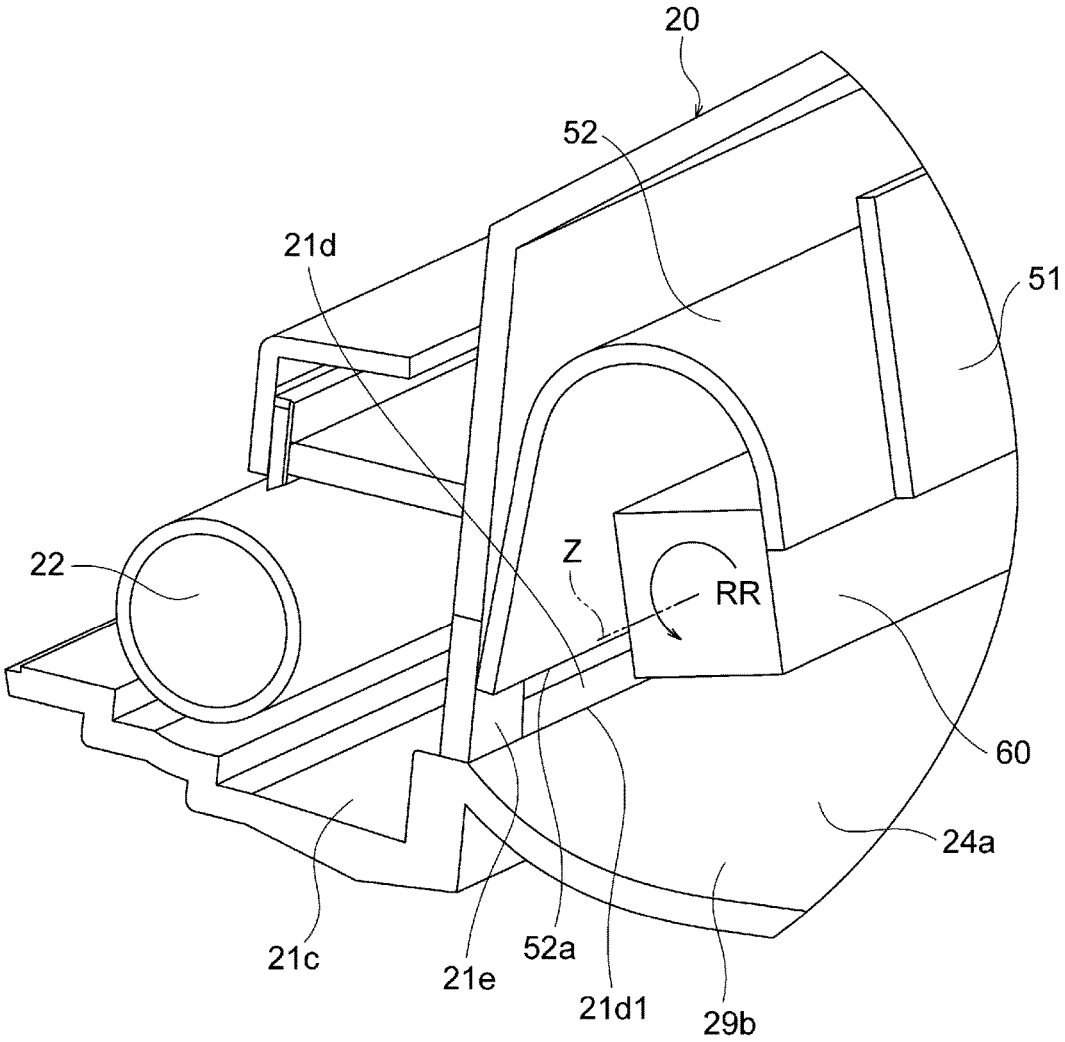
FIG. 8 is a perspective view for illustrating a relationship between the second feeding portion and the developing opening in Embodiment 1.
Figure 9:
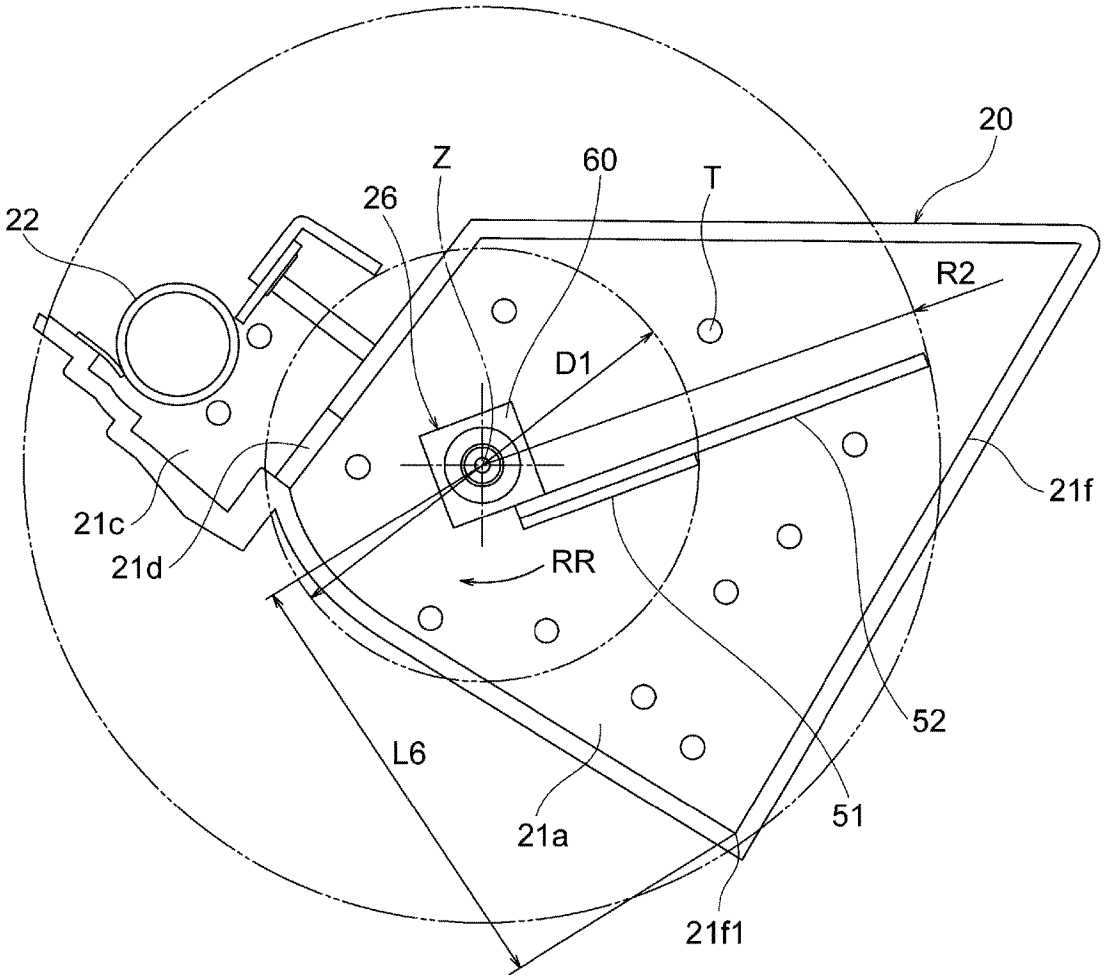
FIG. 9 is a sectional view for illustrating a structure of a developer accommodating portion and the second feeding portion in Embodiment 1.
Figure 10:
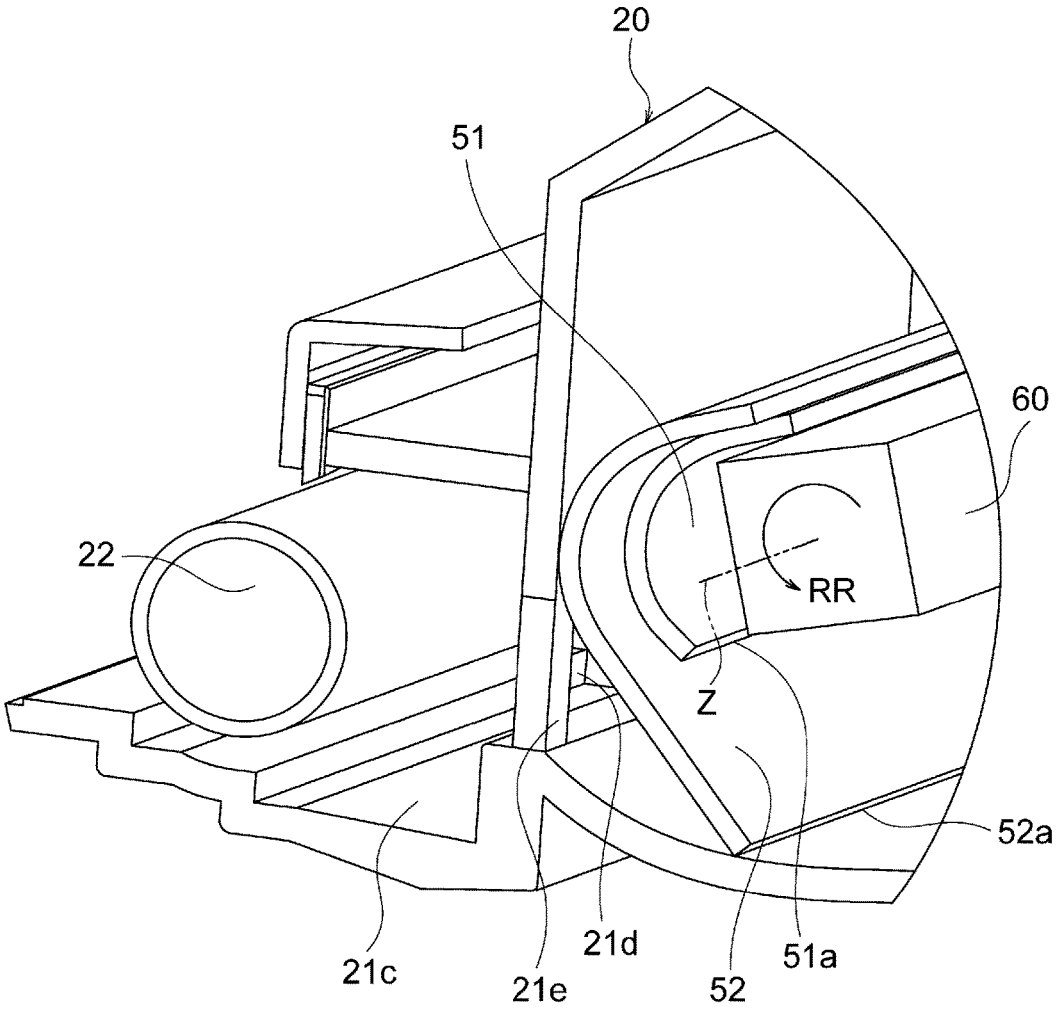
FIG. 10 is a perspective view for illustrating a relationship among the developing opening, the first feeding portion and the second feeding portion in Embodiment 1.
Figure 11:
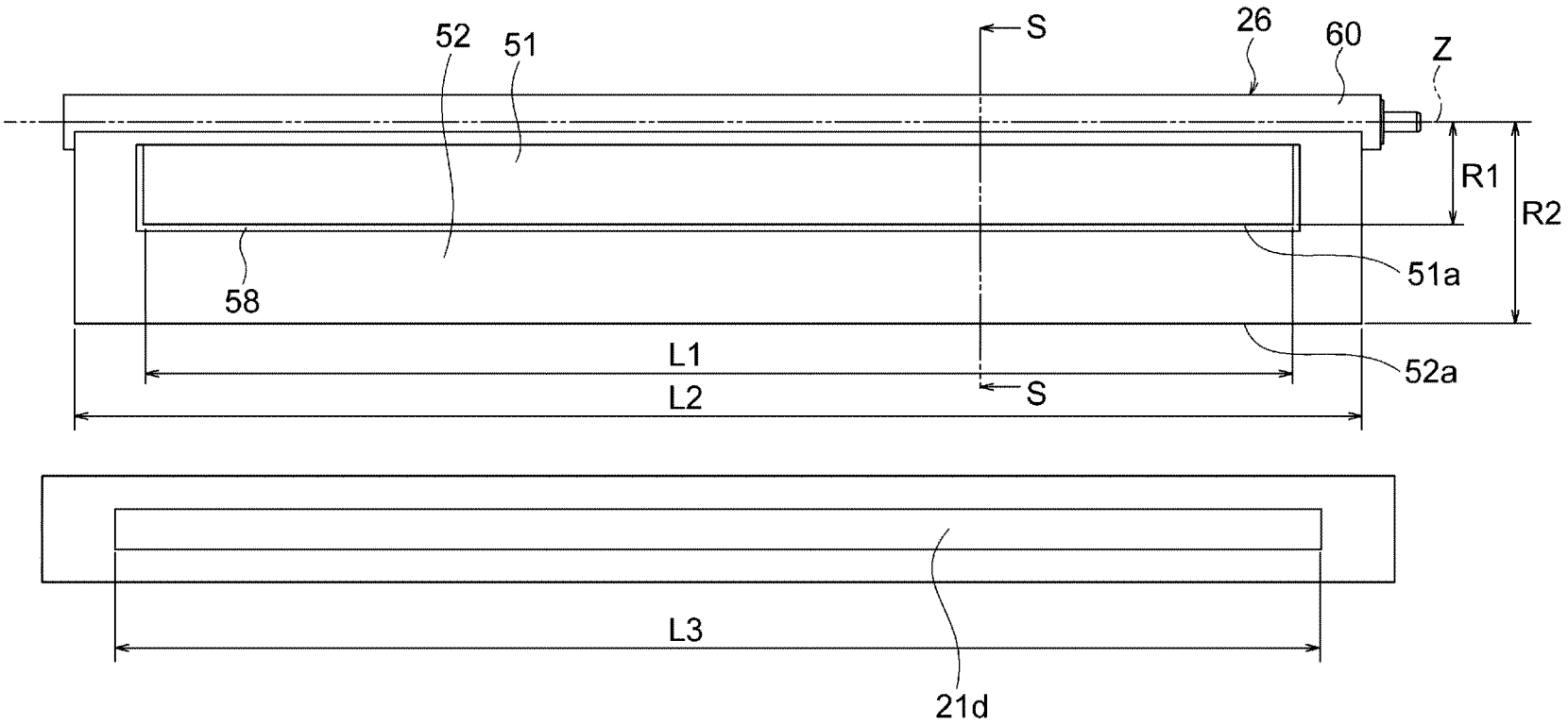
FIG. 11 is a schematic illustration of the developing opening and the stirring means in Embodiment 1.
Figure 12:
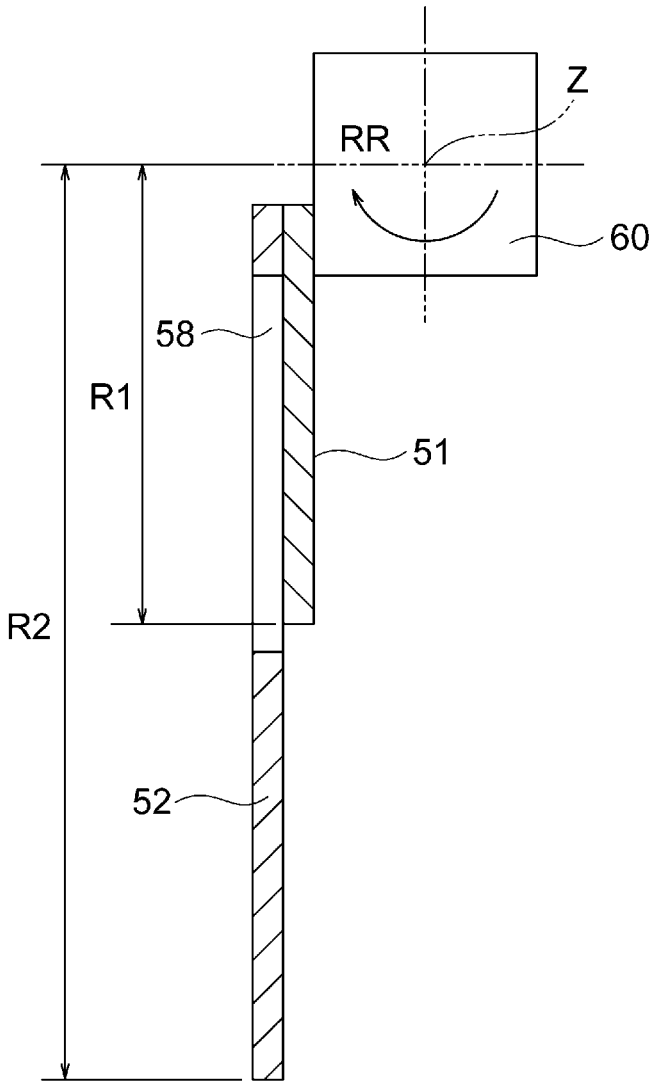
FIG. 12 is a sectional view, taken along a line S-S in FIG. 11, for illustrating a structure of the first feeding portion and the second feeding portion in Embodiment 1.

Behavior of the stirring means 26 in this embodiment will be described with reference to FIGS. 6 to 12. FIGS. 6, 7 and 9 are sectional views, of the developing unit 20, showing the behavior of the stirring means 26 relative to the developing opening 21*d*. FIG. 8 is a perspective view showing a relationship between the second elastic sheet 52 and the developing opening 21*d*. FIG. 10 is a perspective view showing a relationship among the first elastic sheet 51, the second elastic sheet 52 and the developing opening 21*d*. FIG. 11 is an illustration showing the structures of the stirring means 26 and the developing opening 21*d* and a longitudinal positional relationship between the stirring means 26 and the developing opening 21*d*. FIG. 12 is a sectional view, taken along a line S-S in FIG. 11, showing a relationship between the first elastic sheet 51 and the second elastic sheet 52.

First, the behavior of the first elastic sheet 51 will be described with reference to FIGS. 6 and 7.

As shown in (a) of FIG. 6, by the rotation of the shaft member 60 in the rotational direction RR, the first elastic sheet 51 contacts a bottom shape 29*b* when being positioned at a lower portion of the developer accommodating portion 21*a*. Then, the first elastic sheet 51 stirs and feeds the toner T deposited in the developer accommodating portion 21*a* in a flexed state, and approaches the developing opening 21*d*. Then, the first elastic sheet free end portion 51*a* of the first elastic sheet 51 passes through the opening upstream end portion 21*d*1 which is an upstream end portion of the developing opening 21*d* with respect to the rotational direction RR of the stirring means 26, the first elastic sheet 51 is released from the flexed state. As a result, as shown in (b) of FIG. 6, the first elastic sheet free end portion 51*a* enters the developing chamber 21*c*. The first elastic sheet free end portion 51*a* enters the developing chamber 21*c*, whereby the first elastic sheet free end portion 51*a* can also stir the toner T in the developing chamber 21*c*, so that the toner packing in the developing chamber 21*c* can be prevented. Thereafter, as shown in (a) of FIG. 7, the shaft member 60 further rotates in the rotational direction RR, so that the first elastic sheet 51 contacts the opening downstream end portion 21*d*2*w* and then moves into the developer accommodating portion 21*a* while being flexed again. Then, when the first elastic sheet free end portion 51*a* passes through the opening downstream end portion 21*d*2, the first elastic sheet 51 is released from the flexed state, and then returns to the developer accommodating portion 21*a* as shown in (b) of FIG. 7.

Thereafter, by repeating this operation, the first elastic sheet 51 feeds the toner T, in the feeding region D1 in the developer accommodating portion 21*a*, to the developing chamber 21*c*, and stirs the toner T in the developing chamber 21*c* without contacting the developer carrying member 22.

Next, with reference to FIGS. 6 to 9, the behavior of the second elastic sheet 52 relative to the developing opening 21*d* will be described.

As shown in (a) of FIG. 6, the shaft member 60 rotates in the rotational direction RR, so that the second elastic sheet 52 contacts the bottom shape 29*b* when the second elastic sheet 52 is positioned at the lower portion of the developer accommodating portion 21*a*. Then, in a flexed state of the second elastic sheet 52, the second elastic sheet 52 sandwiches the toner T, outside the feed region D1 of the first elastic sheet 51, between itself and the bottom shape 29*b*, and then approaches the developing opening 21*d*.

However, when the second elastic sheet 52 passes through the opening upstream end portion 21*d*1, as shown in FIG. 8, the second elastic sheet 52 contacts end portion walls 21*e* provided at longitudinal end portions of the developing opening 21*d*. As a result, the second elastic sheet free end portion 52*a* cannot enter the developing chamber 21*c*, so that the second elastic sheet 52 continuously rotates in the developer accommodating portion 21*a* together with the rotation of the shaft member 60 in the rotational direction RR.

Therefore, as shown in (b) of FIG. 7, the second elastic sheet 52 does not enter the developing chamber 21*c* and does not contact the developer carrying member 22, so that the second elastic sheet 52 can feed the toner T, outside the feeding region D1 of the first elastic sheet 51, into the feeding region D1.

As shown in (b) of FIG. 7, when a length from the rotation center Z of the shaft member 60 to the opening upstream end portion 21*d*1 of the developing opening 21*d* is a distance L7, the distances L7 and R1 are set to satisfy the relationship of: (distance L7)<(distance R1). By setting the relationship of: (distance L7)<(distance R1), all the toner T fed into the feed region D1 by the second elastic sheet 52 in the developer accommodating portion 21*a* can be fed into the developing chamber 21*c* by the first elastic sheet free end portion 51*a* of the first elastic sheet 51.

Further, as shown in FIG. 9, when a length from the rotation center Z to a lowest rear surface point 21*f*1, which is a remotest point of the developer accommodating portion 21*a*, is a distance L6, the distances L6 and R2 are set to satisfy the relationship of: (distance L6)<(distance R2). By setting the relationship of: (distance L6)<(distance R2), all the toner T in the developer accommodating portion 21*a* can be fed into the feeding region D1 of the second elastic sheet 52.

Further, in order to cause the first elastic sheet 51 to enter the developing chamber 21*c*, with respect to the rotational direction RR of the shaft member 60, there is a need to provide the first elastic sheet 51 in a downstream side and the second elastic sheet 52 in an upstream side. As shown in FIG. 10, in the case where the first elastic sheet 51 is set in the upstream side and the second elastic sheet 52 is set in the downstream side, when the shaft member 60 rotates in the rotational direction RR, the second elastic sheet 52 contacts the end portion walls 21*e*, thus blocking the developing opening 21*d*. As a result, the first elastic sheet 51 cannot enter the developing chamber 21*c*. Therefore, in the case where the first elastic sheet 51 and the second elastic sheet 52 are mounted on the same surface of the shaft member 60, as in this embodiment, it is desirable that the first elastic sheet 51 is positioned in the downstream side relative to the toner T and the second elastic sheet 52 is positioned in the upstream side relative to the toner T.

Further, in the case where the second elastic sheet 52 is set in the downstream side relative to the toner T, as shown in FIGS. 11 and 12, the second elastic sheet 52 may also be provided with a hole 58 through which the first elastic sheet 51 can pass through the second elastic sheet 52. As a result, when the shaft member 60 rotates in the rotational direction RR, the second elastic sheet 52 does not block the developing opening 21*d*. Further, the first elastic sheet 51 and the second elastic sheet 52 may also be mounted on different surfaces of the shaft member 60 so that the second elastic sheet 52 does not block the developing opening 21*d* when the shaft member 60 rotates in the rotational direction RR. In this embodiment, the first elastic sheet 51 and the second elastic sheet 52 are provided on the same surface of the shaft member 60, but the present invention is not limited thereto, and the first elastic sheet 51 and the second elastic sheet 52 may also be fixed on different surfaces, respectively. Further, in the case where the shaft member 60 has a circular shape in cross-section, the first elastic sheet 51 and the second elastic sheet 52 may also be provided at different phases, respectively.

As described above, the distances are set to satisfy the relationships of: (distance L4)<(distance R1)<(distance L5), and (distance L1)<(distance L3)<(distance L2). As a result, with an inexpensive constitution, it is possible to not only cause the stirring means to contact the developer carrying member to permit stirring of the toner in the upsized developer accommodating portion and feeding of the toner into the developing chamber but also stir the toner in the developing chamber.

In this embodiment, the relationship of: (distance L4)<(distance R1)<(distance L5)<(distance R2) is set, but the relationship is not particularly limited to this relationship.

Figure 13:
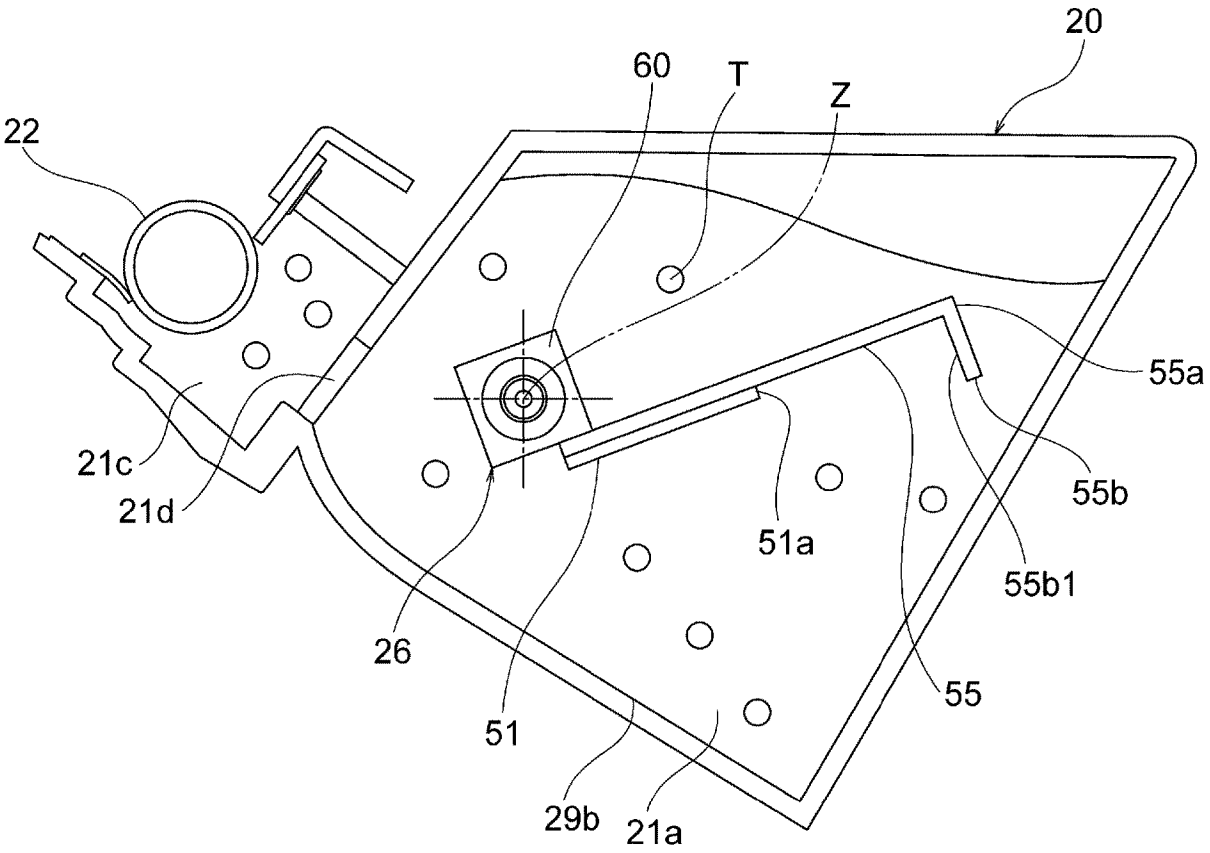
FIG. 13 is a sectional view for illustrating a structure of the developer accommodating portion and the second feeding portion in Embodiment 1.
Figure 14:
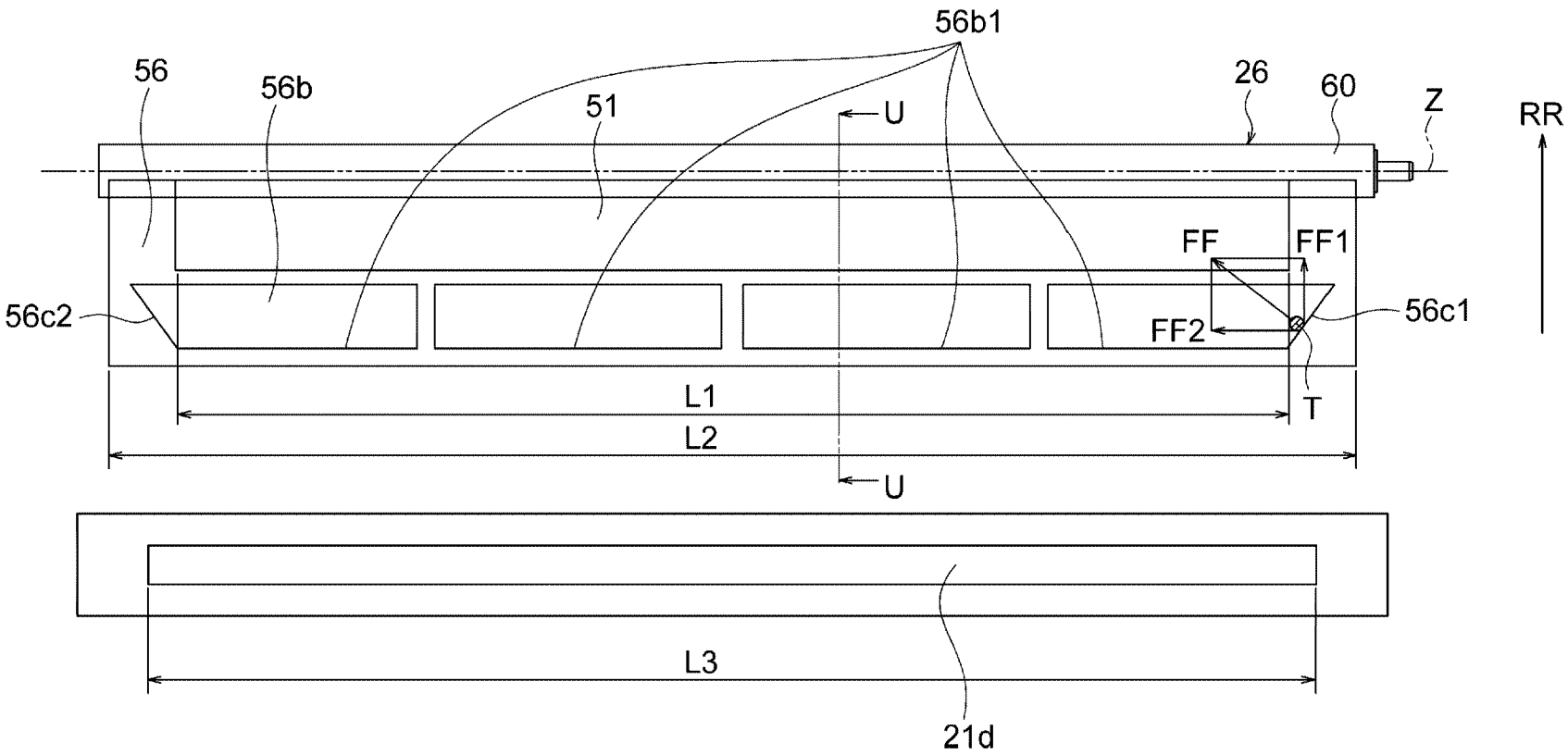
FIG. 14 is a schematic illustration of the developing opening and the stirring means in Embodiment 1.
Figure 15:
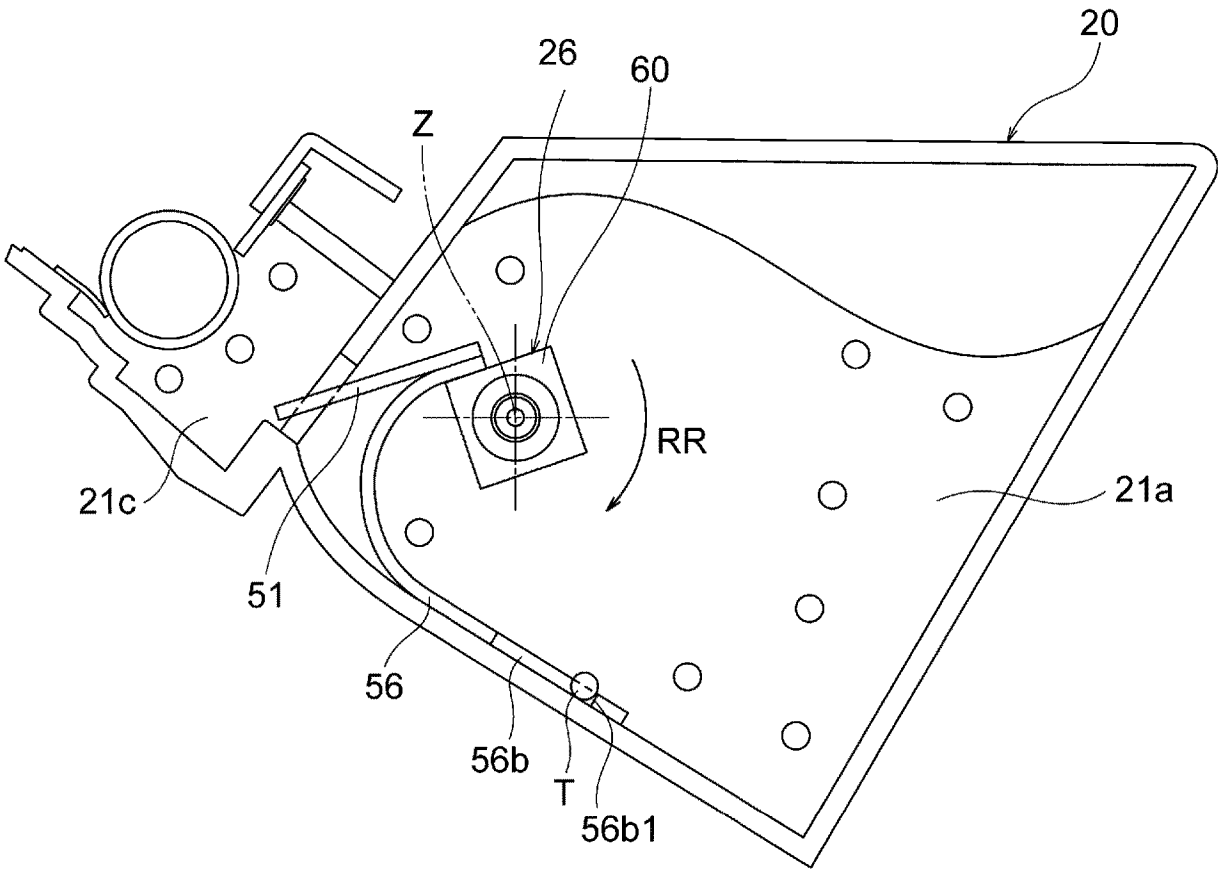
FIG. 15 is a sectional view, showing a developing unit taken along a line U-U in FIG. 14, for illustrating behavior of the second feeding portion in Embodiment 1.

Next, with reference to FIGS. 13 to 15, other shapes of the second elastic sheet 52 will be described. FIG. 13 is a cross-sectional view of the developing unit 20 for illustrating a structure of a second elastic sheet 55. FIG. 14 is an illustration showing structures of a second elastic sheet 56 and the developing opening 21*d* and a longitudinal positional relationship between the second elastic sheet 56 and the developing opening 21*d*. FIG. 15 is a cross-sectional view, of the developing unit 20, showing feeding of the toner T when the second elastic sheet 56 is cut along U-U cross-section in FIG. 14.

As shown in FIG. 13, in order to enhance a toner feeding property of the second elastic sheet 55, a second elastic sheet free end portion 55*a* which is a free end of the second elastic sheet 55 may also be provided with a bent shape 55*b*. By providing the bent shape 55*b*, a surface 55*b*1 of the bent shape 55*b* can contact the toner T, and therefore compared with a constitution in which the bent shape 55*b* is not provided, a contact area between the second elastic sheet (feeding portion) 55 and the toner T is increased, so that the toner T feeding property can be improved.

Further, the shape for enhancing the toner T feeding property is not limited to the bent shape 55*b*, but as shown in FIG. 14, the second elastic sheet 56 may also be provided with holes 56*b*. By providing the second elastic sheet 56 with the holes 56*b*, as shown in FIG. 15, a surface 56*b*1 defined by the holes 56*b* can contact the toner T. For that reason, compared with the constitution in which the holes 56*b* are not provided, a contact area between the second elastic sheet 56 and the toner T is increases, so that the toner T feeding property can be improved. The shape of the holes 56*b* is not limited to a rectangular shape, but may also be a circular shape or the like.

Further, as shown in FIG. 14, at end portions of the holes 56*b*, inclined surfaces 56*c*1 and 56*c*2 along which the toner T is to be moved toward a central portion of the developer carrying member 22 may also be provided. By providing the inclined surfaces 56*c*1 and 56*c*2, when the shaft member 60 is rotated in the rotational direction RR, with respect to the toner T contacting each of the inclined surfaces 56*c*1 and 56*c*2, a feeding force FF in a direction perpendicular to the associated inclined surface 56*c*1 or 56*c*2 generates. This feeding force FF includes a feed component force FF2 which is a component force, of the feeding force FF, in a direction substantially parallel to the longitudinal direction, and therefore the toner T is moved from longitudinal end portions toward the longitudinal central portion. Therefore, also the toner T outside the developing opening 21*d* with respect to the longitudinal direction can be fed through the developing opening 21*d* by the first elastic sheet 51, so that it is possible to prevent the toner T from remaining at the longitudinal end portions.

Further, in FIGS. 14 and 15, as the shape of the holes provided in the second elastic sheet, the structure having the through holes 56*b* is illustrated, but the shape of the holes provided in the second elastic sheet is not limited thereto. For example, a structure in which a non-through hole portion (recessed portion) is provided on the downstream surface of the second elastic sheet with respect to the rotational direction may also be employed, and also by this structure, a similar effect can be obtained.

Embodiment 2

Figure 16:
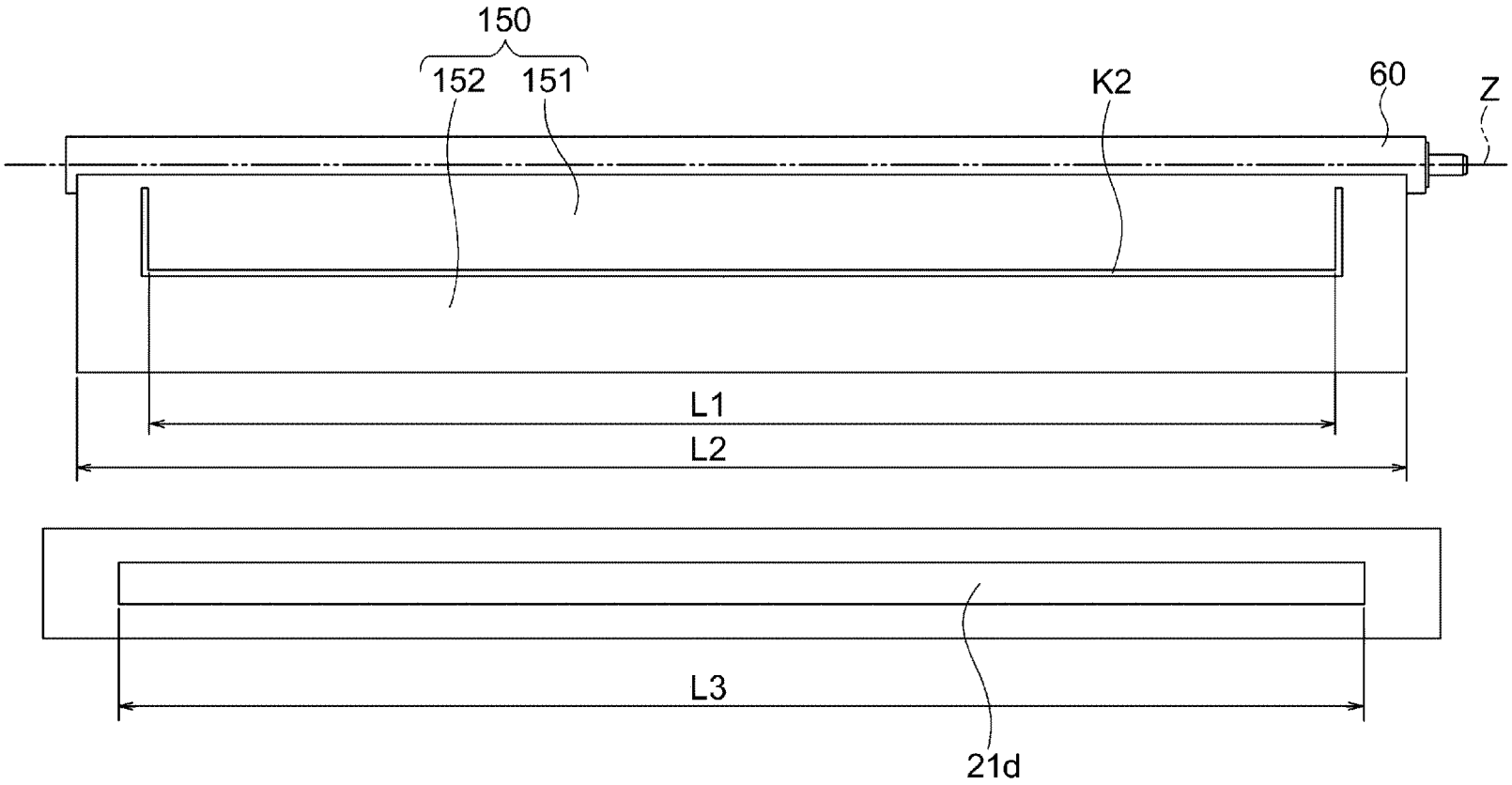
FIG. 16 is a schematic illustration of an elastic sheet and a developing opening in Embodiment 2.
Figure 17:
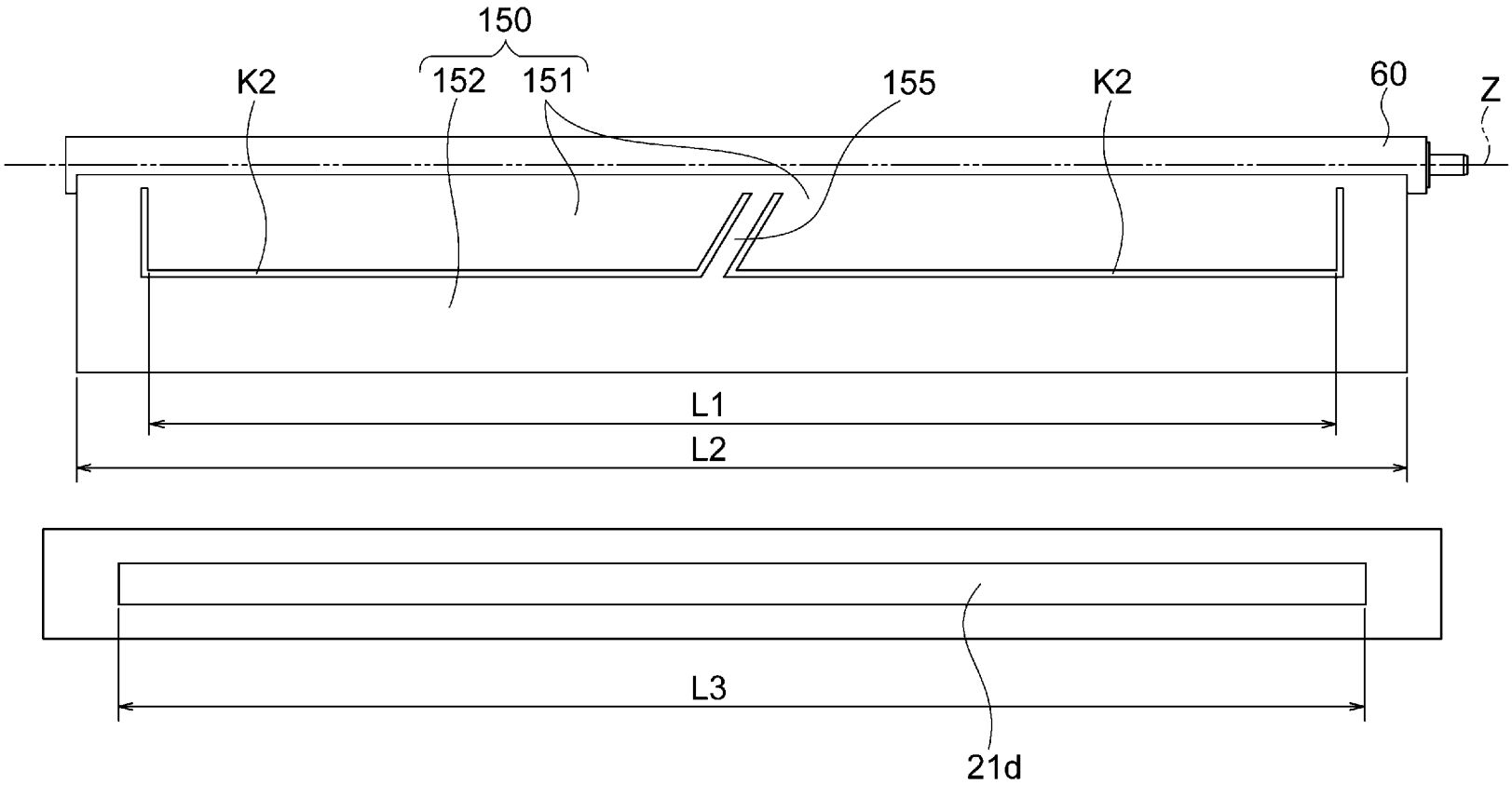
FIG. 17 is a schematic illustration of another elastic sheet and the developing opening in Embodiment 2.
Figure 18:
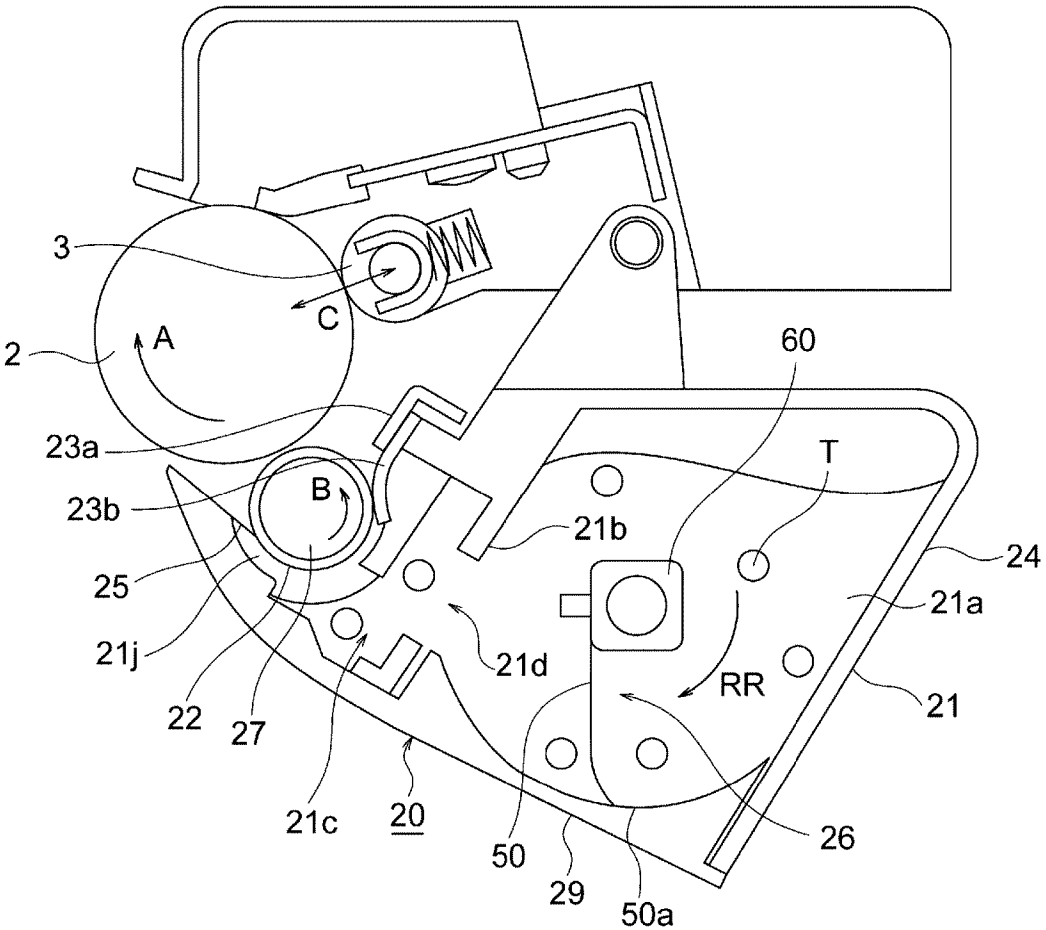
FIG. 18 is a sectional view showing a conventional process cartridge.

A structure of a stirring means in a developing device according to Embodiment 2 will be described with reference to FIGS. 16 and 17. FIGS. 16 and 17 are schematic views showing structures of an elastic sheet 150 and a developing opening 121*d* and a longitudinal positional relationship between the elastic sheet 150 and the developing opening 121*d*.

In Embodiment 1, the first elastic sheet 51 and the second elastic sheet 52 are described as the separate members, but the present invention is not limited thereto. In this embodiment, the stirring means is constituted by a flexible single sheet member including a first feeding portion and a second feeding portion. Specifically, as shown in FIG. 16, the elastic sheet 150 is provided with a cut-away portion K2 to define a first elastic sheet portion 151 as the first feeding portion and a second elastic sheet portion 152 as the second feeding portion which are formed with the same member (flexible single sheet member). By forming the first elastic sheet portion 151 and the second elastic sheet portion 152 with the same member, the present invention can be carried out with an inexpensive constitution compared with the case of the separate members.

Further, as shown in FIG. 17, at a longitudinal central portion of an elastic sheet 150, a connecting portion 155 is provided, so that rigidity of a second elastic sheet portion 152 can be improved. Therefore, the toner feeding force of the second elastic sheet portion 152 during rotation of a shaft member 160 can be improved.

By the above-described constitution, with an inexpensive constitution compared with Embodiment 1, it is possible to not only stir the toner in the upsized developer accommodating portion and feed the toner into the developing chamber but also stir the toner in the developing chamber without bringing the stirring means into contact with the developer carrying member.

Other Embodiments

In the above-described embodiments, as the process cartridge detachably mountable to the main assembly of the image forming apparatus, the process cartridge integrally including the photosensitive drum, and the charging means, the developing means and the cleaning means which are the process means actable on the photosensitive drum was described as an example. However, the process cartridge is not limited thereto. For example, a process cartridge including, in addition to the photosensitive drum, either one of the charging means, the developing means and the cleaning means may also be used.

Further, in the above-described embodiments, the constitution in which the process cartridge including the photosensitive drum is detachably mountable to the main assembly of the image forming apparatus was described as an example. For example, it is also possible to use an image forming apparatus in which respective constituent members are incorporated or an image forming apparatus in which each of the constituent members is detachably mounted.

Further, in the above-described embodiments, the printer was described as an example, but the present invention is not limited thereto. For example, other image forming apparatuses such as a copying machine, a facsimile machine and a multi-function machine having functions of these machines may also be used. By applying the present invention to these image forming apparatuses, it is possible to obtain a similar effect.

According to the present invention, it is possible to not only feed the developer, in the upsized developer accommodating portion, into the developing chamber but also stir the developer in the developing chamber with an inexpensive constitution.

While the invention has been described with reference to the structures disclosed herein, it is not confined to the details set forth and this application is intended to cover such modifications or changes as may come within the purpose of the improvements or the scope of the following claims.

This application claims priority from Japanese Patent Applications Nos. 014167/2014 filed Jan. 29, 2014 and 228903/2014 filed Nov. 11, 2014, which are hereby incorporated by reference.

What is claimed is:

1. A developing device comprising:

a developer carrying member for developing an electrostatic image with a developer;

a developer container including a developer accommodating portion for accommodating the developer, a developing opening, and a developing chamber; and a developer supplying member for supplying the developer to said developing chamber through said developing opening, wherein said developer supplying member includes a shaft member rotatably supported by said developer accommodating portion and a feeding member, wherein said feeding member includes a first sheet which has a length L1 measured in an axial direction of said developer carrying member and a radial length R1 measured from a rotation center of said shaft member to a free end of said first sheet, and includes a second sheet which has a length L2 measured in the axial direction of said developer carrying member and a radial length R2 measured from the rotation center of said shaft member to a free end of said second sheet within an area corresponding to a length of said developing opening in the axial direction of said developer carrying member, wherein with respect to a rotational direction of said shaft member, said first sheet is provided in a downstream side, and said second sheet is provided in an upstream side, said first sheet and said second sheet are fixed on a same surface of said shaft member in a state that a fixed end of said first sheet and a fixed end of said second sheet overlap with each other in a direction perpendicular to an axial direction of said shaft member, and wherein when the length of said developing opening in the axial direction is L3, a shortest length from said developing opening to the rotation center of said shaft member is L4, and a shortest length from said developer carrying member to the rotation center of said shaft member is L5, the following relationships are satisfied:

$$L1<L3<L2,$$

$$L4<R1<L5, \text{ and}$$

$$R1<R2.$$

2. A developing device according to claim 1, wherein a distance from the rotation center of said shaft member to an upstream end portion of said developing opening at a surface opposing said developer accommodating portion with respect to a rotational direction of said developer supplying member is L7, the distances R1 and L7 satisfy the following relationship:

$$R1>L7.$$

3. A developing device according to claim 1, wherein said first sheet and said second sheet feed the developer positioned at a center of said developer carrying member in an axial direction of said developer carrying member.

4. A developing device according to claim 1, wherein said first sheet and said second sheet feed the developer in an overlapping region with respect to a rotational direction.

5. A developing device according to claim 1, wherein said radial length R2 is larger than L5.

6. A developing device according to claim 1, wherein said second sheet is disposed between said first sheet and said shaft member.

7. A developing device according to claim 1, wherein an axial center of said shaft member is positioned below an axial center of said developer carrying member in a developing operation.

8. A developing device according to claim 1, wherein an upper end portion of said developing opening is positioned below an axial center of said developer carrying member in a developing operation.

9. A developing device according to claim 1, wherein the length L1 of said first sheet is a continuous length measured in the axial direction of said developer carrying member, and the length L2 of said second sheet is a continuous length measured in the axial direction of said developer carrying member.

10. A developing device according to claim 1, wherein the radial length R2 is measured from the rotation center of said shaft member to the free end of said second sheet within an area corresponding to a length of said shaft member in the axial direction of said developer carrying member.

11. A process cartridge detachably mountable to a main assembly of an electrophotographic forming apparatus, comprising:

an image bearing member for bearing an electrostatic image, and a developing device according to claim 1.

12. A developing device according to claim 1, wherein said first and second sheets are elastic sheets.

* * * * *